US009057387B2

(12) United States Patent
Sun et al.

(10) Patent No.: US 9,057,387 B2
(45) Date of Patent: Jun. 16, 2015

(54) SERIES FAN ASSEMBLY STRUCTURE

(75) Inventors: Sung-Wei Sun, New Taipei (TW); Zuo Zhi, New Taipei (TW); Xiang-Ping Zhang, Sinjhuang (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 545 days.

(21) Appl. No.: 13/530,562

(22) Filed: Jun. 22, 2012

(65) Prior Publication Data

US 2013/0343871 A1 Dec. 26, 2013

(51) Int. Cl.

| | |
|---|---|
| ***F01D 1/24*** | (2006.01) |
| ***F04D 29/60*** | (2006.01) |
| ***F04D 25/16*** | (2006.01) |

(52) U.S. Cl.

CPC ..... *F04D 29/601* (2013.01); *F04D 25/166* (2013.01)

(58) Field of Classification Search

CPC ..... F04D 3/005; F04D 13/14; F04D 19/002; F04D 19/02; F04D 25/08; F04D 25/166; F04D 29/4253; F04D 29/601

See application file for complete search history.

(56) References Cited

U.S. PATENT DOCUMENTS

| | | | | |
|---|---|---|---|---|
| 6,547,540 | B1 * | 4/2003 | Horng et al. | 415/208.2 |
| 6,612,817 | B2 * | 9/2003 | Lin et al. | 415/199.5 |
| 7,156,611 | B2 * | 1/2007 | Oosawa et al. | 415/68 |
| 7,654,792 | B2 * | 2/2010 | Kikuichi et al. | 415/68 |
| 8,123,461 | B2 * | 2/2012 | Yoshida et al. | 415/68 |
| 2005/0024829 | A1 * | 2/2005 | Horng et al. | 361/695 |
| 2007/0003413 | A1 * | 1/2007 | Hsu et al. | 415/199.5 |
| 2007/0059155 | A1 * | 3/2007 | Ishihara et al. | 415/60 |
| 2009/0022587 | A1 * | 1/2009 | Yoshida et al. | 415/213.1 |
| 2009/0246015 | A1 * | 10/2009 | Hsu | 415/213.1 |
| 2010/0329859 | A1 * | 12/2010 | Chen et al. | 415/198.1 |

* cited by examiner

*Primary Examiner* — Igor Kershteyn

(57) ABSTRACT

A series fan assembly structure includes a first fan frame and a second fan frame. The first fan frame has a first latch section, a second latch section, a first engagement recess, a second engagement recess, a first retainer section and a second retainer section. The second fan frame has a third latch section, a fourth latch section, a third engagement recess, a fourth engagement recess, a third retainer section and a fourth retainer section. The first and second engagement recesses are respectively connected with the third and fourth latch sections, the first and second latch sections are respectively connected with the third and fourth engagement recesses and the first and second retainer sections are respectively connected with the third and fourth retainer sections. Accordingly, the first and second fan frames can be quickly assembled and securely connected in both axial direction and radial direction.

16 Claims, 6 Drawing Sheets

SERIES FAN ASSEMBLY STRUCTURE

BACKGROUND OF THE INVENTION

1. Field of the Invention

The present invention relates generally to a series fan assembly structure, and more particularly to a series fan assembly structure, which can be quickly assembled at higher axial and radial connection tightness.

2. Description of the Related Art

Along with the advance of sciences and technologies, the reliance of peoples on various electronic apparatuses has more and more increased. In operation, the internal components of the electronic products (such as computers and laptops) will generate high heat. The heat must be dissipated to outer side of the electronic products in time. Otherwise, the problem of overheating will take place. Therefore, most of the electronic products are provided with fans disposed therein for keeping the electronic products working at an operation temperature within a range. However, in some cases, the air volume provided by one single fan is sufficient. To overcome this problem, two or more fans are often serially assembled to provide sufficient air volume.

For example, Taiwanese Patent Publication No. 481434 discloses a cooling device for a central processing unit. The cooling device includes radiating fins and at least two fans. The cooling device is characterized in that the first and second fans are serially mated with each other to form a series fan. Several connection posts are disposed between the first and second fans to space the first and second fans by a certain distance. Accordingly, when the radiating fins absorb the high heat generated by the central processing unit, the series fan provides larger wind pressure and larger air volume so as to speed heat dissipation and enhance cooling effect.

In the above patent, the four corners of the fan frame of each fan are formed with through holes. Accordingly, screws can be passed through the through holes of the fans to serially connect the fans and lock the fans on the radiating fins.

In practice, the fans cannot be securely serially connected simply by means of the screws. This is because when locked with the screws, the forced points reside on one side of one fan, rather than on the connection faces of both fans. Therefore, the serial connection force is insufficient. As a result, the fans tend to make noise in operation. Also, the fluid is likely to escape from the gap between the connection faces. This will affect the air volume acting on the heat sink and deteriorate the heat dissipation performance.

Moreover, the cost for the conventional structure for fixing the series cooling fan is higher. In addition, the conventional series cooling fan has insufficient assembling strength and poor tightness. After assembled, the series cooling fan is likely to radially and axially vibrate. Accordingly, in the case that the fan operates at high rotational speed or is applied to an environment of a server or a telecommunication chassis, the fan is apt to loosen or detach.

Another type of conventional series cooling fan is assembled in another manner. One of the fans to be serially assembled has multiple through holes on four corners, while the other fan has at least one boss body positioned in a position in alignment with the through hole. The boss body is correspondingly inserted into the through hole to fixedly serially connect the two fans. However, by means of the above fixing measure, the series cooling fan still cannot be tightly connected. As a result, the series cooling fan is still likely to vibrate and make noise.

According to the above, the conventional technique has the following shortcomings:

1. The tightness of the conventional series fan is poor.
2. The conventional series fan is likely to vibrate and make noise.
3. The conventional series fan is hard to assemble.

SUMMARY OF THE INVENTION

It is therefore a primary object of the present invention to provide a series fan assembly structure, which can be quickly assembled.

It is a further object of the present invention to provide the above series fan assembly structure in which the first and second fan frames can be securely connected in both axial direction and radial direction.

To achieve the above and other objects, the series fan assembly structure of the present invention includes a first fan frame and a second fan frame.

The first fan frame has a first plane face having a first side, a second side, a third side opposite to the first side and a fourth side opposite to the second side. On the first side is disposed a first latch section having a first latch channel. On the second side is disposed a second latch section having a second latch channel. On the third side is disposed a first engagement recess. On the fourth side is disposed a second engagement recess. The first plane face is formed with a first retainer section and a second retainer section.

The second fan frame has a second plane face having a fifth side, a sixth side, a seventh side opposite to the fifth side and an eighth side opposite to the sixth side. On the fifth side is disposed a third latch section having a third latch channel. On the sixth side is disposed a fourth latch section having a fourth latch channel. On the seventh side is disposed a third engagement recess. On the eighth side is disposed a fourth engagement recess. The second plane face is formed with a third retainer section and a fourth retainer section. The first and second engagement recesses are respectively connected with the third and fourth latch sections, while the first and second latch sections are respectively connected with the third and fourth engagement recesses. The first and second retainer sections are respectively correspondingly connected with the third and fourth retainer sections.

The first and second fan frames of the series fan assembly structure can be quickly assembled and located. Also, the first and second fan frames can be securely connected with each other in both axial direction and radial direction without loosening or detachment. Therefore, in operation, the series fan will not vibrate or make noise.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
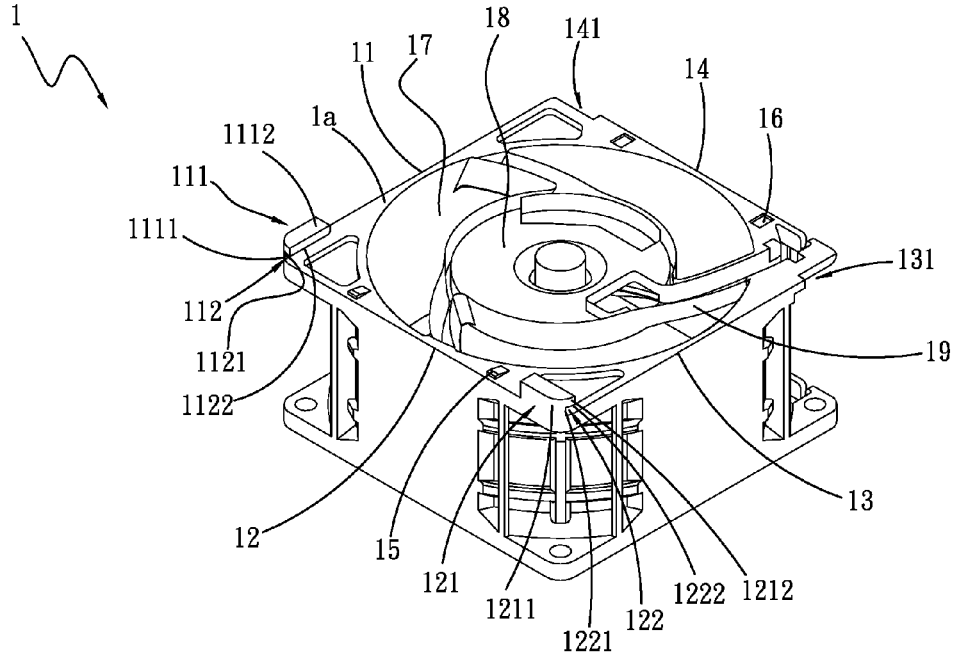
FIG. 1 is a perspective view of the first fan frame of a first embodiment of the series fan assembly structure of the present invention.
Figure 2:
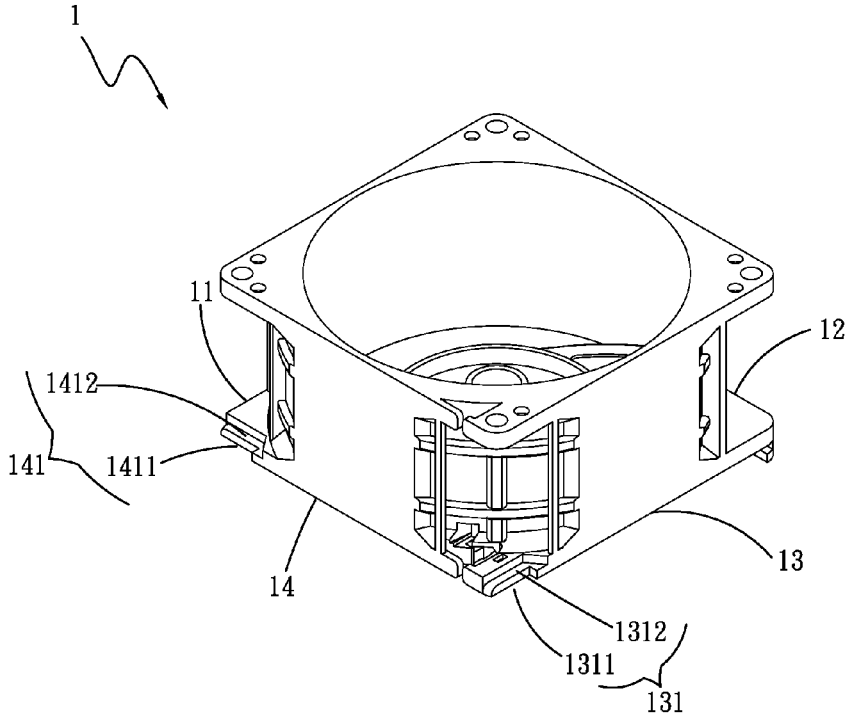
FIG. 2 is another perspective view of the first fan frame of the first embodiment of the series fan assembly structure of the present invention.
Figure 3:
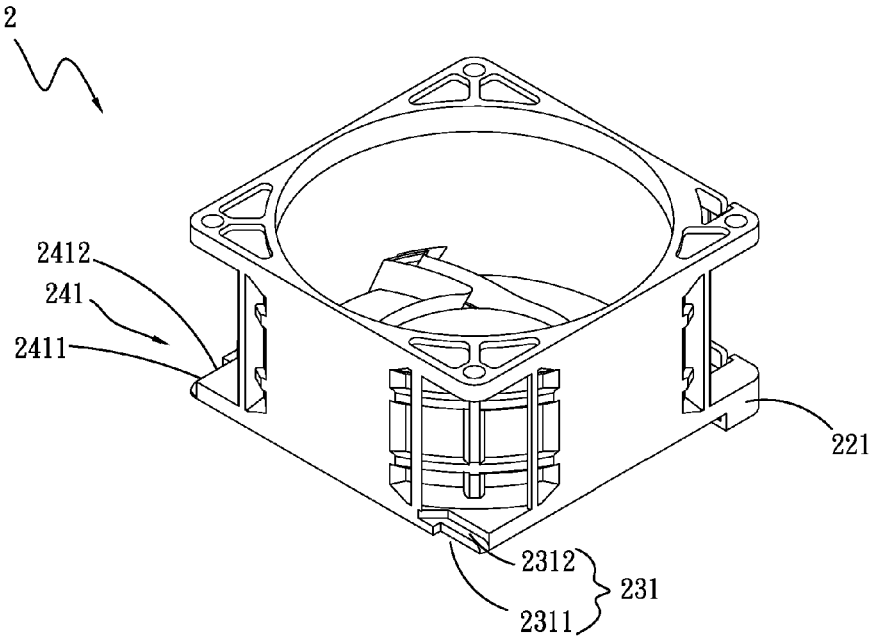
FIG. 3 is a perspective view of the second fan frame of the first embodiment of the series fan assembly structure of the present invention.
Figure 4:
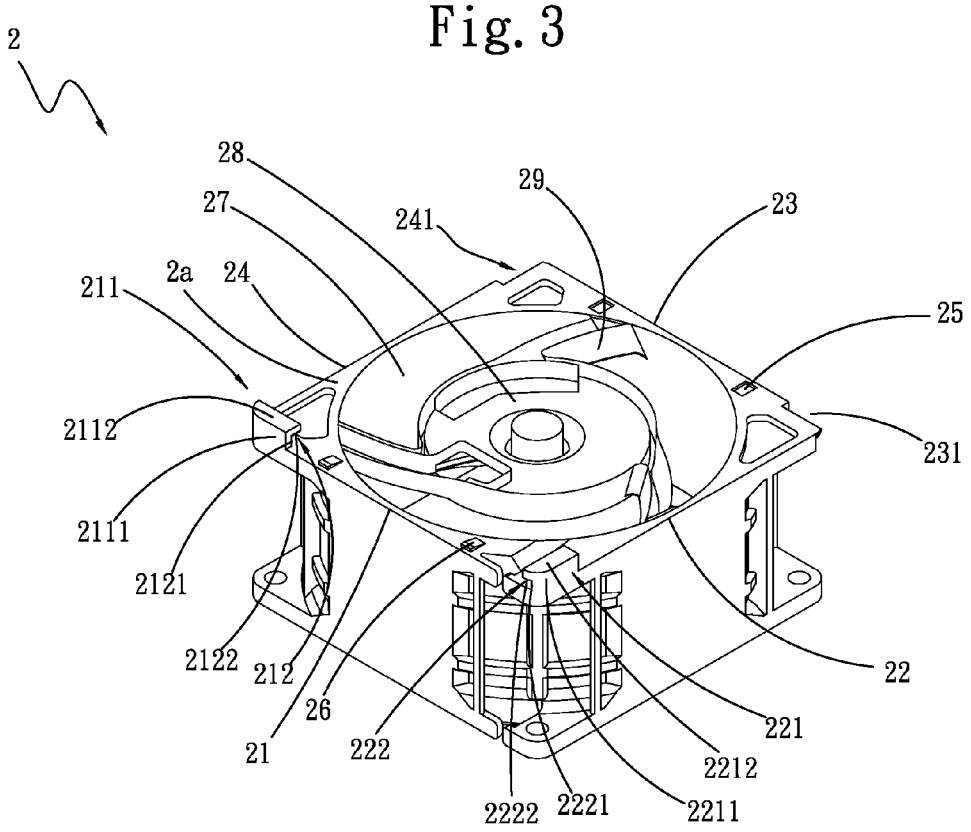
FIG. 4 is another perspective view of the second fan frame of the first embodiment of the series fan assembly structure of the present invention.
Figure 5:
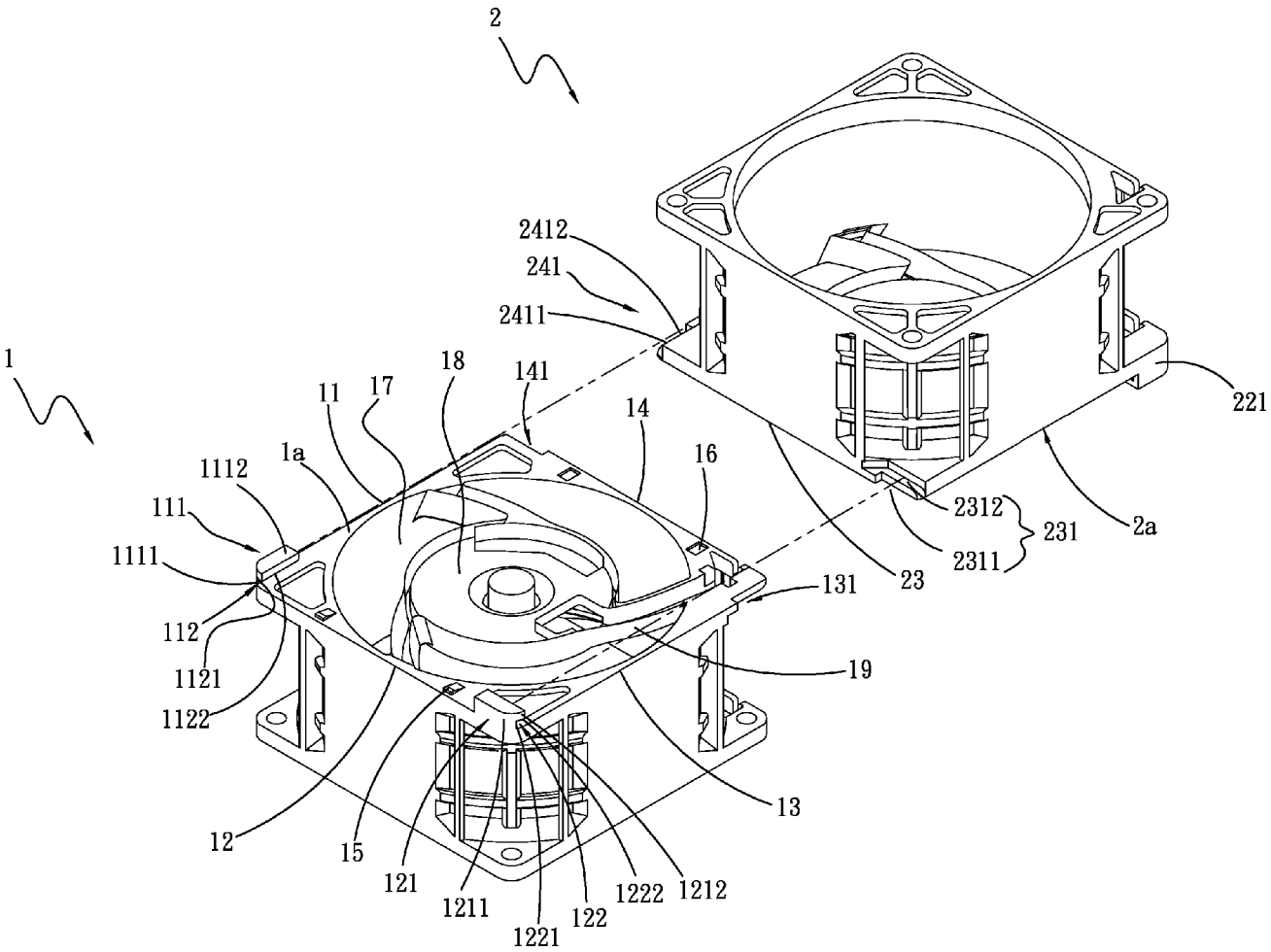
FIG. 5 is a perspective exploded view of the first embodiment of the series fan assembly structure of the present invention.
Figure 6:
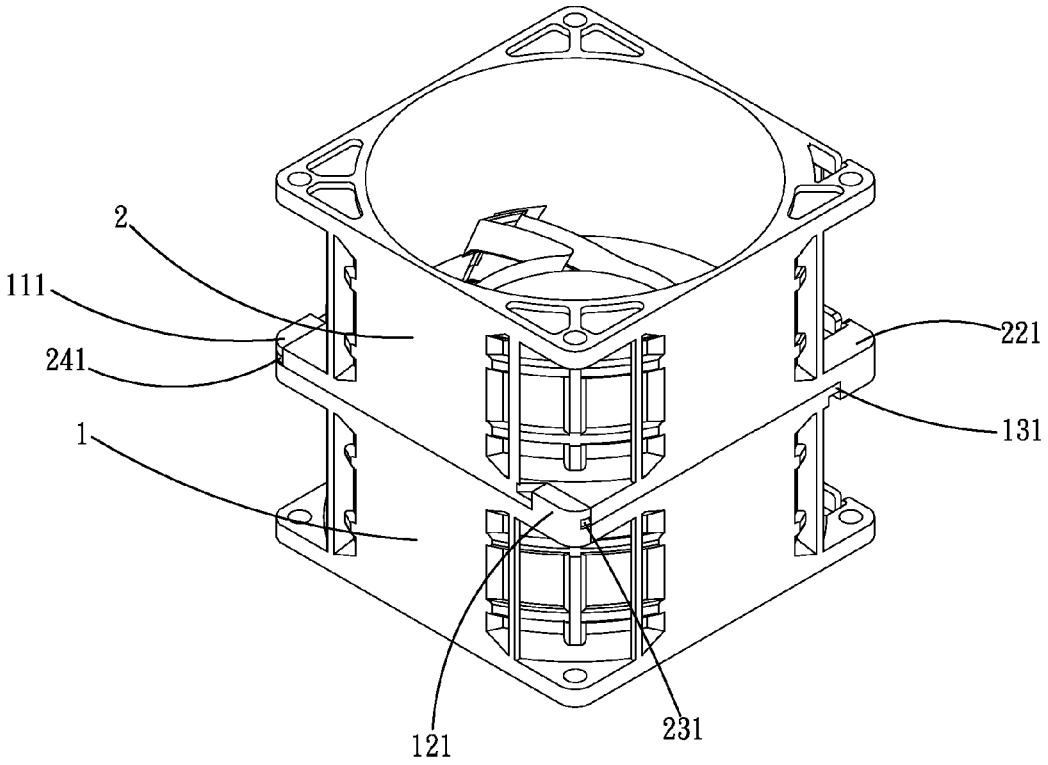
FIG. 6 is a perspective assembled view of the first embodiment of the series fan assembly structure of the present invention.

Please refer to FIGS. 1, 2, 3, 4, 5 and 6. FIG. 1 is a perspective view of the first fan frame of a first embodiment of the series fan assembly structure of the present invention. FIG. 2 is another perspective view of the first fan frame of the first embodiment of the series fan assembly structure of the present invention. FIG. 3 is a perspective view of the second fan frame of the first embodiment of the series fan assembly structure of the present invention. FIG. 4 is another perspective view of the second fan frame of the first embodiment of the series fan assembly structure of the present invention. FIG. 5 is a perspective exploded view of the first embodiment of the series fan assembly structure of the present invention. FIG. 6 is a perspective assembled view of the first embodiment of the series fan assembly structure of the present invention. According to the first embodiment, the series fan assembly structure of the present invention includes a first fan frame 1 and a second fan frame 2.

The first fan frame 1 has a first plane face 1*a* having a first side 11, a second side 12, a third side 13 opposite to the first side 11 and a fourth side 14 opposite to the second side 12.

On the first side 11 is disposed a first latch section 111 having a first latch channel 112. On the second side 12 is disposed a second latch section 121 having a second latch channel 122. On the third side 13 is disposed a first engagement recess 131. On the fourth side 14 is disposed a second engagement recess 141.

The first latch section 111 has a first extension section 1111 and a second extension section 1112. The first extension section 1111 extends from the first plane face 1*a* in a direction away from the first plane face 1*a*. The second extension section 1112 perpendicularly extends from the first extension section 1111 in a direction away from the first extension section 1111. The first and second extension sections 1111, 1112 together define the first latch channel 112.

The first latch channel 112 has a first connection face 1121 and a second connection face 1122 perpendicular to the first connection face 1121.

The second latch section 121 has a third extension section 1211 and a fourth extension section 1212. The third extension section 1211 extends from the first plane face 1*a* in a direction away from the first plane face 1*a*. The fourth extension section 1212 perpendicularly extends from the third extension section 1211 in a direction away from the third extension section 1211. The third and fourth extension sections 1211, 1212 together define the second latch channel 122.

The second latch channel 122 has a third connection face 1221 and a fourth connection face 1222 perpendicular to the third connection face 1221.

The first engagement recess 131 has a first notch 1311 and a first stepped section 1312.

The second engagement recess 141 has a second notch 1411 and a second stepped section 1412.

The first plane face 1*a* is formed with a first retainer section 15 and a second retainer section 16.

The first fan frame 1 further has a first flow passage 17, a first bearing cup 18 and multiple ribs 19. The first bearing cup 18 extends from the first plane face 1*a* in a direction away from the first plane face 1*a*. Two ends of the ribs 19 are respectively connected to the first bearing cup 18 and the first fan frame 1.

The second fan frame 2 has a second plane face 2*a* having a fifth side 21, a sixth side 22, a seventh side 23 opposite to the fifth side 21 and an eighth side 24 opposite to the sixth side 22.

On the fifth side 21 is disposed a third latch section 211 having a third latch channel 212. On the sixth side 22 is disposed a fourth latch section 221 having a fourth latch channel 222. On the seventh side 23 is disposed a third engagement recess 231. On the eighth side 24 is disposed a fourth engagement recess 241.

The third latch section 211 has a fifth extension section 2111 and a sixth extension section 2112. The fifth extension section 2111 extends from the second plane face 2*a* in a direction away from the second plane face 2*a*. The sixth extension section 2112 perpendicularly extends from the fifth extension section 2111 in a direction away from the fifth extension section 2111. The fifth and sixth extension sections 2111, 2112 together define the third latch channel 212. The third latch channel 212 has a fifth connection face 2121 and a sixth connection face 2122 perpendicular to the fifth connection face 2121. The third engagement recess 231 has a third notch 2311 and a third stepped section 2312. One side of the third notch 2311 is correspondingly attached to the third connection face 1221 of the third extension section 1211. The third stepped section 2312 is correspondingly attached to the fourth connection face 1222 of the fourth extension section 1212.

The fourth latch section 221 has a seventh extension section 2211 and an eighth extension section 2212. The seventh extension section 2211 extends from the second plane face 2*a* in a direction away from the second plane face 2*a*. The eighth extension section 2212 perpendicularly extends from the seventh extension section 2211 in a direction away from the seventh extension section 2211. The seventh and eighth extension sections 2211, 2212 together define the fourth latch channel 222. The fourth latch channel 222 has a seventh connection face 2221 and an eighth connection face 2222 perpendicular to the seventh connection face 2221.

The seventh and eighth connection faces 2221, 2222 are respectively attached to the first notch 1311 and the first stepped section 1312 of the first engagement recess 131.

The fourth engagement recess 241 has a fourth notch 2411 and a fourth stepped section 2412. One side of the fourth notch 2411 is correspondingly attached to the first connection face 1121 of the first extension section 1111. The fourth stepped section 2412 is correspondingly attached to the second connection face 1122 of the second extension section 1112.

The second plane face 2*a* is formed with a third retainer section 25 and a fourth retainer section 26.

The second fan frame 2 further has a second flow passage 27, a second bearing cup 28 and multiple ribs 29. Two ends of the ribs 29 are respectively connected to the second bearing cup 28 and the second fan frame 2.

Please now refer to FIGS. 5 and 6. When assembling the first fan frame 1 with the second fan frame 2, the seventh side 23 of the second fan frame 2 contacts the fourth side 14 of the first fan frame 1 and is horizontally slid to the second side 12 so as to engage and assemble the second fan frame 2 with the first fan frame 1. At this time, the first plane face 1*a* is attached to the second plane face 2*a* and the first and second engagement recesses 131, 141 are respectively connected with the third and fourth latch sections 211, 221 and the first and second latch sections 111, 121 are respectively connected with the third and fourth engagement recesses 231, 241. Also, the first and second retainer sections 15, 16 are respectively correspondingly connected with the third and fourth retainer sections 25, 26. The first and second retainer sections 15, 16 and the third and fourth retainer sections 25, 26 are recessed and raised sections complementary to each other.

Figure 7:
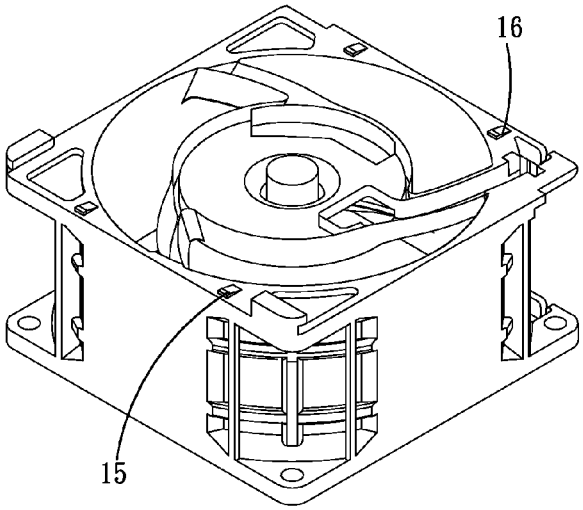
FIG. 7 is a perspective view of the first fan frame of a second embodiment of the series fan assembly structure of the present invention.
Figure 8:
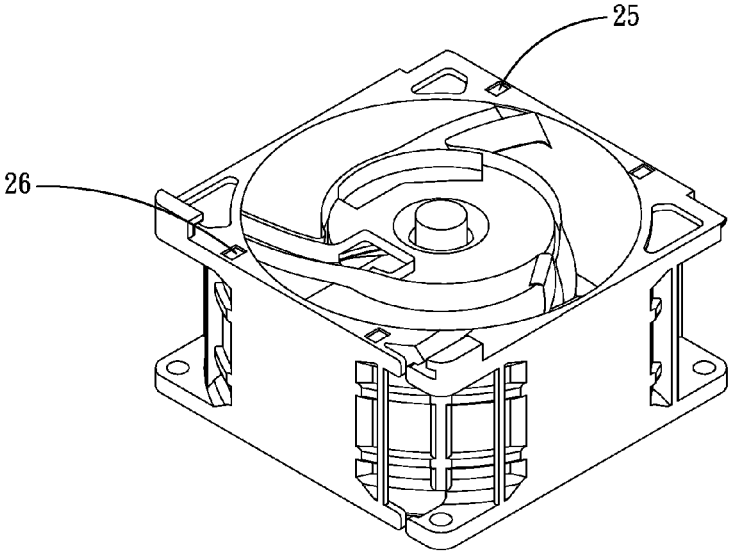
FIG. 8 is a perspective view of the second fan frame of the second embodiment of the series fan assembly structure of the present invention.

Please now refer to FIGS. 7 and 8. FIG. 7 is a perspective view of the first fan frame of a second embodiment of the series fan assembly structure of the present invention. FIG. 8 is a perspective view of the second fan frame of the second embodiment of the series fan assembly structure of the present invention. The second embodiment is partially identical to the first embodiment in structure and thus will not be repeatedly described hereinafter. The second embodiment is different from the first embodiment in that the first retainer section 15 is a raised section, while the third retainer section 25 is a recessed hole corresponding to the first retainer section 15 and the second retainer section 16 is a raised section, while the fourth retainer section 26 is a recessed hole corresponding to the second retainer section 16.

Figure 9:
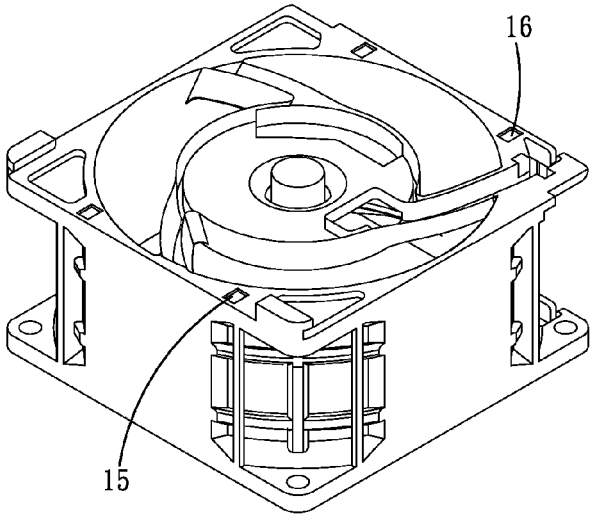
FIG. 9 is a perspective view of the first fan frame of a third embodiment of the series fan assembly structure of the present invention.
Figure 10:
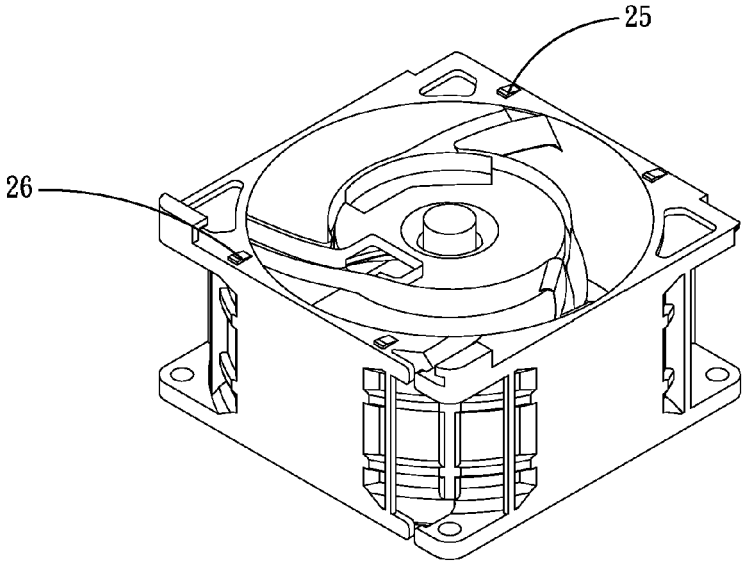
FIG. 10 is a perspective view of the second fan frame of the third embodiment of the series fan assembly structure of the present invention.

Please now refer to FIGS. 9 and 10. FIG. 9 is a perspective view of the first fan frame of a third embodiment of the series fan assembly structure of the present invention. FIG. 10 is a perspective view of the second fan frame of the third embodiment of the series fan assembly structure of the present invention. The third embodiment is partially identical to the second embodiment in structure and thus will not be repeatedly described hereinafter. The third embodiment is different from the second embodiment in that the first retainer section 15 is a recessed hole, while the third retainer section 25 is a raised section corresponding to the first retainer section 15 and the second retainer section 16 is a recessed hole, while the fourth retainer section 26 is a raised section corresponding to the second retainer section 16.

In conclusion, in comparison with the conventional series fan, the present invention has the following advantages:

1. The first and second fan frames can be quickly connected and located.

2. The first and second fan frames are securely assembled in both axial direction and radial direction.

The present invention has been described with the above embodiments thereof and it is understood that many changes and modifications in the above embodiments can be carried out without departing from the scope and the spirit of the invention that is intended to be limited only by the appended claims.

What is claimed is:

1. A series fan assembly structure comprising:

a first fan frame having a first plane face having a first side, a second side, a third side opposite to the first side and a fourth side opposite to the second side, on the first side being disposed a first latch section having a first latch channel, on the second side being disposed a second latch section having a second latch channel, on the third side being disposed a first engagement recess, on the fourth side being disposed a second engagement recess, the first plane face being formed with a first retainer section and a second retainer section; and a second fan frame having a second plane face having a fifth side, a sixth side, a seventh side opposite to the fifth side and an eighth side opposite to the sixth side, on the fifth side being disposed a third latch section having a third latch channel, on the sixth side being disposed a fourth latch section having a fourth latch channel, on the seventh side being disposed a third engagement recess, on the eighth side being disposed a fourth engagement recess, the second plane face being formed with a third retainer section and a fourth retainer section, the first and second engagement recesses being respectively connected with the third and fourth latch sections, while the first and second latch sections being respectively connected with the third and fourth engagement recesses, the first and second retainer sections being respectively correspondingly connected with the third and fourth retainer sections.

2. The series fan assembly structure as claimed in claim 1, wherein the first and second retainer sections and the third and fourth retainer sections are recessed and raised sections complementary to each other.

3. The series fan assembly structure as claimed in claim 2, wherein the first retainer section is a raised section, while the third retainer section is a recessed hole corresponding to the first retainer section and the second retainer section is a raised section, while the fourth retainer section is a recessed hole corresponding to the second retainer section.

4. The series fan assembly structure as claimed in claim 2, wherein the first retainer section is a recessed hole, while the third retainer section is a raised section corresponding to the first retainer section and the second retainer section is a recessed hole, while the fourth retainer section is a raised section corresponding to the second retainer section.

5. The series fan assembly structure as claimed in claim 1, wherein the first latch section has a first extension section and a second extension section, the first extension section extending from the first plane face in a direction away from the first plane face, the second extension section perpendicularly extending from the first extension section in a direction away from the first extension section, the first and second extension sections together defining the first latch channel.

6. The series fan assembly structure as claimed in claim 1, wherein the first latch channel has a first connection face and a second connection face perpendicular to the first connection face.

7. The series fan assembly structure as claimed in claim 1, wherein the second latch section has a third extension section and a fourth extension section, the third extension section extending from the first plane face in a direction away from the first plane face, the fourth extension section perpendicularly extending from the third extension section in a direction away from the third extension section, the third and fourth extension sections together defining the second latch channel.

8. The series fan assembly structure as claimed in claim 1, wherein the second latch channel has a third connection face and a fourth connection face perpendicular to the third connection face.

9. The series fan assembly structure as claimed in claim 1, wherein the third latch channel has a fifth connection face and a sixth connection face perpendicular to the fifth connection face.

10. The series fan assembly structure as claimed in claim 1, wherein the fourth latch channel has a seventh connection face and an eighth connection face perpendicular to the seventh connection face.

11. The series fan assembly structure as claimed in claim 8, wherein the third engagement recess has a third notch and a third stepped section, one side of the third notch being correspondingly attached to the third connection face and the third stepped section being correspondingly attached to the fourth connection face.

12. The series fan assembly structure as claimed in claim 6, wherein the fourth engagement recess has a fourth notch and a fourth stepped section, one side of the fourth notch being correspondingly attached to the first connection face and the fourth stepped section being correspondingly attached to the second connection face.

13. The series fan assembly structure as claimed in claim 1, wherein the first fan frame further has a first flow passage, a first bearing cup and multiple ribs, the first bearing cup extending from the first plane face in a direction away from the first plane face, two ends of the ribs being respectively connected to the first bearing cup and the first fan frame, the second fan frame further having a second flow passage, a second bearing cup and multiple ribs, the second bearing cup extending from the second plane face in a direction away from the second plane face, two ends of the ribs being respectively connected to the second bearing cup and the second fan frame.

14. The series fan assembly structure as claimed in claim 1, wherein the seventh side of the second fan frame contacts the fourth side of the first fan frame and is horizontally slid to the second side so as to engage and assemble the second fan frame with the first fan frame with the first plane face attached to the second plane face.

15. The series fan assembly structure as claimed in claim 10, wherein the first engagement recess has a first notch and a first stepped section, one side of the first notch being correspondingly attached to the seventh connection face and the first stepped section being correspondingly attached to the eighth connection face.

16. The series fan assembly structure as claimed in claim 9, wherein the second engagement recess has a second notch and a second stepped section, one side of the second notch being correspondingly attached to the fifth connection face and the second stepped section being correspondingly attached to the sixth connection face.

* * * * *